United States Patent [19]

Martin et al.

[11] 4,141,452

[45] Feb. 27, 1979

[54] TOOL HANGER

[76] Inventors: Joe L. Martin, 2038 Palm, #132, Las Vegas, Nev. 89104; Jerry D. Martin, 502 Kump St., Bonner Springs, Kans. 66012

[21] Appl. No.: 863,418

[22] Filed: Dec. 22, 1977

[51] Int. Cl.[2] ..... B65D 85/20; A47F 7/03

[52] U.S. Cl. ..... 211/60 T; 248/309 R

[58] Field of Search ..... 211/60 T, 65, 66, 69.1, 211/60 R, 62, 63, 68; 248/309, 110, 111; 294/92

[56] References Cited

U.S. PATENT DOCUMENTS

| | | | |
|---|---|---|---|
| 1,432,206 | 10/1922 | Poole | 248/110 UX |
| 1,908,926 | 5/1933 | Severance | 294/92 |
| 1,938,158 | 12/1933 | Steele | 294/92 |
| 2,894,366 | 7/1959 | Leckie | 57/149 |
| 2,987,285 | 6/1961 | Andrews | 211/66 X |

FOREIGN PATENT DOCUMENTS

| | | | |
|---|---|---|---|
| 111749 | 9/1925 | France | 211/66 |
| 468971 | 3/1950 | Italy | 211/66 |

*Primary Examiner*—J. Franklin Foss

*Attorney, Agent, or Firm*—Seiler & Quirk

[57] ABSTRACT

A hanger for holding implements such as garden tools comprises a mounting bracket and a gripping member connected by a flexible cord. An aperture in the gripping member receives the tool handle, which is held in the gripping member by friction. The friction grip may be endhanced by having a slight angle in the gripping member, and by applying a frictional surface, such as a rubber grommet, ridges, or the like, to the edges of the aperture.

5 Claims, 5 Drawing Figures

TOOL HANGER

BACKGROUND OF THE INVENTION

The problem of the storage of both long and short handled tools has been an irritation to shop owners and homeowners for many years. In many cases, long handled tools such as rakes, hoes, shovels, mops, brooms, and the like are simply leaned up against the wall in a closet or a garage. This arrangement is often inconvenient, in that the tools are not easily accessible, any may frequently fall into a pile. Similarly, a problem has been encountered with short handled tools such as hammers, trowels, sledges, and the like. These tools are normally stored in a cabinet or in a box, and are not conveniently available, particularly if their frequent use (e.g. around a workbench) is desired.

Recognizing these problems, a number of persons have attempted to create an organizational system for these tools. Several holders are described in the prior art; for example, Belcher, U.S. Pat. No. 1,206,655, describes a holder for a mop, broom, or carpet sweeper which consists of a wall-mounted hinged ring, with the ring being retractable by a spring when not in use. The ring has a series of teeth located around the periphery of the ring to grip the tool handle. Dixon, U.S. Pat. No. 2,422,891 shows a similar ring-type holder, wherein the ring has an upwardly extending lip on the rear portion which engages a bracket permanently affixed to a wall. The handle of the implement is thrust upwardly from beneath the ring; when the handle is released, the weight of the handle urges the ring downwardly and into frictional engagement therewith. Both the Belcher and Dixon devices have the disadvantage that the handle must be placed substantially parallel and near the wall before inserting the handle in the ring, and that the device must be mounted at a level higher than the handle length to be operable.

A similar holder for both short and long-handled implements is described in Longfellow, U.S. Pat. No. 2,898,657. This patent discloses a device very similar to the Dixon device, except that the ring is open on one side, allowing the implement to be inserted from the side rather than from below. Yet another device is described in Andrews, U.S. Pat. No. 2,987,285; the Andrews device consists of a flexible double loop which is adjustable in the middle by a sliding ferrule. Frictional force is exerted by the loop, the ferrule, and a sponge rubber ball at the top of the hanger serve to hold an implement in place.

The present invention relates to a frictional tool hanger which can be used for both long and short-handled tools, and which is easily adjustable to hold the tools at any height. By simple sliding adjustment, the tools can be lowered to a level easily reached by children, or can be raised beyond their reach. In addition, placement of tools in the hanger of the invention is very easy because the operating member of the hanger is on the end of a flexible cord and is easily held in one hand while the tool is inserted with the other hand. Therefore, the device is easily used by children or handicapped persons.

Accordingly, it is an object of the invention to provide a holder for long and short-handled tools which is easy to manufacture and install, and which is easily adjustable to tools of various shapes and sizes. It is another object of the invention to provide a hanger which is very easy to use, in that the hanger can be held well away from a wall while the tool is inserted in the hanger. It is still another object of the invention to provide a hanger which may be installed away from a vertical wall, e.g., on a beam or ceiling. These and other objects of the invention will be clear to one skilled in the art from the following description of a specific mode of the invention.

BRIEF SUMMARY OF THE INVENTION

A hanger for holding implements having elongated handles comprises a mounting bracket, a gripping member comprising a frame, an aperture in the frame, friction gripping means for holding an elongated handle in said aperture, flexible cord means extending from the mounting bracket to the gripping member, and adjustment means for varying the length of the flexible cord extending between the mounting bracket and gripping member.

BRIEF DESCRIPTION OF THE DRAWINGS

The invention is better understood with reference to the attached drawings, in which.

DETAILED DESCRIPTION OF A SPECIFIC EMBODIMENT

Figure 1:
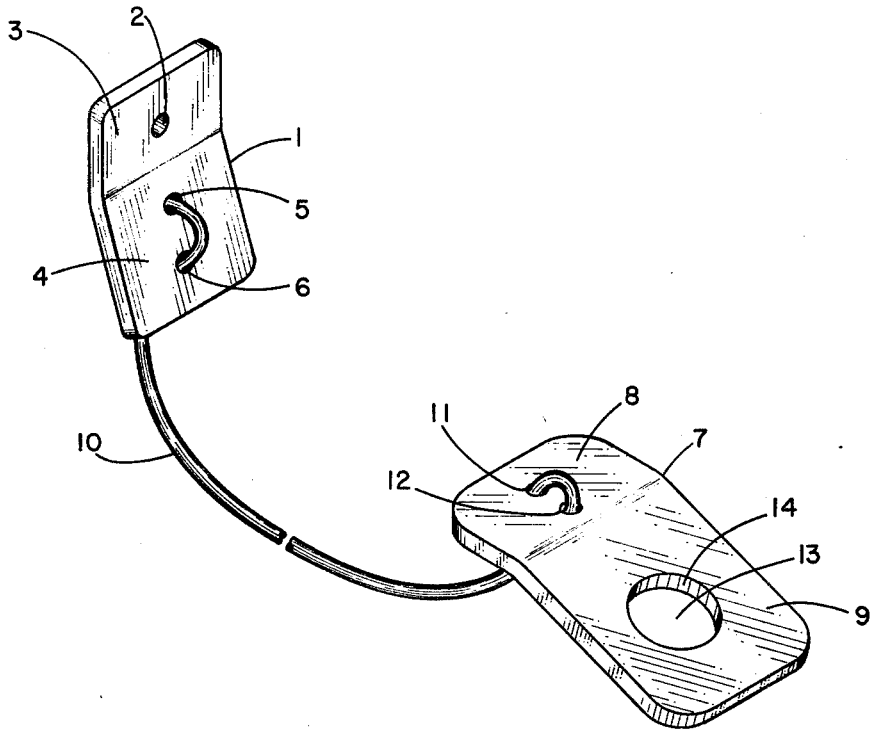
FIG. 1 is a perspective view of the hanger, showing the mounting bracket and the tool holder.

Referring to the drawings, FIG. 1 shows mounting bracket 1, which is a piece of clear lucite plastic approximately 1-½" × 2" × ¼", which has bore 2 extending through the width thereof for attachment to a wall, ceiling, or the like by means of a nail or screw (not shown). The mounting bracket has an upper portion 3 and lower portion 4 offset at a slight angle to enable cord 10 to hand freely away from the wall.

Figure 4:
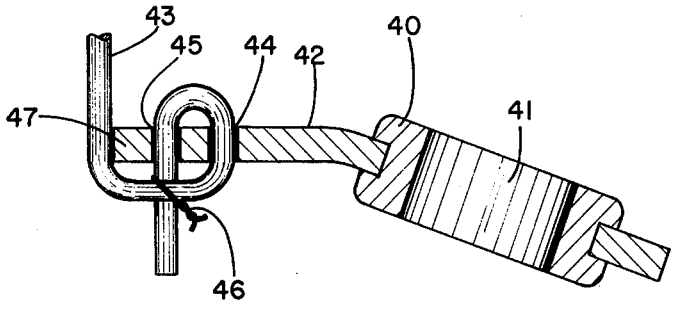
FIG. 4 is a section view of the gripping member showing the attachment of the flexible cord.

A gripping member 7 is attached to the mounting bracket by flexible nylon cord 10. The gripping member also consists of a rigid lucite block having dimensions of approximately 1-½" × 4" × ¼". The gripping member has a mounting flange section 8 offset at approximately a 25° angle from gripping section 9. The gripping section has a centrally located circular bore 13, the edges of which form frictional gripping surface 14. The frictional surface may be roughened, or may have an added frictional component. For example, the surface may be dipped in a rubberizing or plasticizing liquid which sets to form a frictional surface, or a rubber grommet, such as is shown in FIG. 4, may be used to increase the gripping capability of the hanger. The diameter of the hole is preferably 1" to 1-½", depending upon the implement to be held; the larger diameters are generally used for heavier implements such as shovels or picks.

The mounting bracket and gripping member are joined by a flexible plastic-coated nylon cord having a diameter of about 3/16". The cord may be attached to each member by any means, but is preferably attached in a manner that will allow easy adjustment of the length of the cord between the two members. As shown in FIGS. 1 and 4, a simple way of mounting the cord is to thread it through two spaced holes, designated as 5 and 6 on the mounting bracket and 11 and 12 on the gripping member. The frictional grip of the cord in the mounting bores caused by the weight of any implement held in the gripping member is sufficient to securely fasten the cord to each member without slippage, although an additional tie such as the crimped wire tie shown in FIG. 4 may be used if desired. Alternatively, the cord can simply be threaded through one hole in each member and tied in a knot. The method of mounting the cord shown in FIG. 1 is desirable because the length of the cord is easily adjustable by sliding the cord through the holes to make the distance between the gripping member and the mounting bracket shorter or longer. If desired, an extension coil spring or metal chain could be used in place of a cord to hold the implements in an elevated position.

Figure 2:
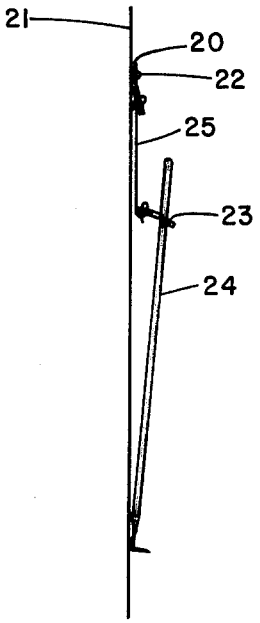
FIG. 2 is a side view showing the use of the tool holder to hold a hoe.

The tool hanger of the invention is adaptable to a wider variety of uses than similar devices of the prior art. The device of the invention may be used for long or short-handled tools of any size, and may be used to hang tools along a wall, from a beam, or from the ceiling. FIG. 2 shows a side view of a hoe stored along a wall with a tool hanger of the invention. Mounting bracket 20 is mounted on wall 21 with screw 22; the hoe 24 is held in the gripping member 23 by inserting its handle through the hole in the gripping member, then releasing the gripping member. The weight of the hoe raises the rear portion of the gripping member, tilting the forward portion thereof toward the ground. The friction between the edge of the aperture and the gripping member and the handle of the hoe easily maintains the hoe in elevated position. Flexible cord 25 is maintained under tension by the weight of the hoe. The height at which the hoe blade is maintained above the ground may be adjusted either by extending the handle of the hoe further through the gripping member, or by adjusting the length of the flexible cord.

Figure 3:
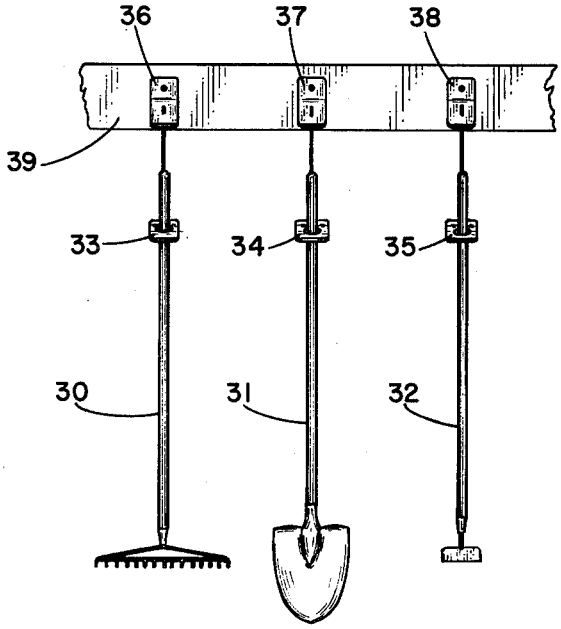
FIG. 3 shows the use of several tool holders attached to a beam.

FIG. 3 shows the use of tool hangers of the invention to hang various garden tools from a beam. Rake 30, shovel 31, and hoe 32 are shown hanging from beam 39 by gripping members 33, 34, and 35. Mounting brackets 36, 37, and 38 respectively, are shown attached side by side along the beam. The mounting brackets can also easily be mounted on a ceiling, thereby allowing the storage of either short or long-handled tools away from the wall, for example, over a workbench. The mounting brackets can be mounted on a ceiling in circular formation, thereby allowing easy accessibility to an operator working at a bench of a variety of tools. This possibility is not apparent with tool hangers of the prior art, which require mounting on a vertical wall. Because of the ease of adjustability of the height of the gripping member above ground level, both short and long-handled tools may be hung from the same beam or ceiling simply by adjusting the length of the flexible cord.

FIG. 4 shows a side section view of the gripping member of a hanger according to the invention, with a rubber grommet or gasket inserted in the handle bore to increase the friction between the gripping member and the tool handle. Grommet 40 is press fitted into bore 41 of gripping member 42, and provides protection of the surface of the tool handle as well as additional frictional properties. FIG. 4 also shows a preferred method of threading the flexible cord through the gripping member. Flexible cord 43 extends through the forward hole 44 in the flange portion of the gripping member and returns along the top of the flange through hole 45, where metal tie 46 is applied to insure against slippage of the cord. When a tool handle is inserted upwardly through the grommet and released, the weight of the tool pulls the gripping member downwardly and forwardly, and flexible cord 43 is stretched around the rear edge 47 of the gripping member flange. The friction of the cord against the rear edge of the flange serves to provide leverage to retain the cord and tool in place.

Figure 5:
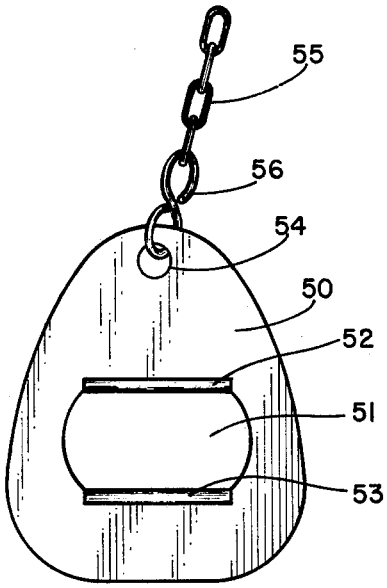
FIG. 5 is a top view of a gripping member having straight, parallel gripping surfaces.

FIG. 5 shows yet another configuration of the gripping member of the tool hanger of the invention. The gripping member consists of a non-angled, flat rigid 1/16" sheet metal piece 50 having an irregular shaped bore 51 with rubger covered rear and front edges 52 and 53, respectively. In this example, both gripping edges in the tool holder bore are straight and parallel to each other. This design is particularly useful for implements having irregular shaped handles, such as hammers and some types of shovels. For this design, it has been found that a frictional coating of rubber, plastic, or the like is especially important, as the surface area of contact between the gripping member and the tool handle is likely to be quite small. The gripping member is attached to chain 55 by threading through hole 54. The chain is connected to the gripping member by "S"-shaped clip 56. The metal piece 50 may have a bead around the periphery of the piece and around the aperture for additional strength.

The tool hanger of the invention has a number of advantages which enable its use in a variety of situations. The tool hanger allows an implement with an extra long handle or pole to be suspended in a location in which a hanger fixed to the wall, such as those of the prior art, may be limiting. Similarly, a tool having a very large working end, such as a carpet sweeper, is easily stored because of the flexibility of the cord between the mounting bracket and the gripping means, whereas it would not be possible to thread the handle through a gripping member which is directly adjacent to the wall. In addition, the flexible cord will permit the gripping member to be located at a sufficiently low height for children or short people to use, or may be optionally located at a height sufficiently high to prohibit the use by children.

Specific design parameters, such as shapes and dimensions, may vary according to taste and projected usage. For most home and shop uses, cord lengths of from 1' to 6', preferably 2' to 4', are sufficient. The angle between the flange section and gripping portion of the gripping member is preferably between 10° and 35°, more preferably 20° to 30°. Most tools, however, can be inserted from either side of the hole without impeding the ability of the device to grip the tool.

Many variations may be made to the specific devices disclosed herein within the spirit and scope of the invention, which relates to a tool hanger having a separate mounting member and gripping member which are separated by a flexible cord. Accordingly, while a description of several preferred embodiments of the invention has been set forth, the descriptions should be considered illustrative rather than limiting, and the invention should be limited only by the following claims.

I claim:

1. A hanger for holding implements having elongated handles comprises:

mounting means, a gripping member comprising a rigid frame, an aperture in said frame, a resilient rubber grommet mounted in said aperture for holding an elongated handle in said aperture, said gripping member comprising a gripping portion containing the aperture and a flange portion extending from the gripping portion at an angle of from about 10° to about 35°, and the flange portion comprises attachment means for securing the flexible connecting means to the gripping member flexible connecting means for attaching the mounting means to the gripping member, and adjustment means for varying the length of the flexible connecting means.

2. The hanger of claim 1 wherein the flexible connecting means comprises a cord having a length of between 1 foot and 6 feet.

3. The hanger of claim 1 wherein the angle between the gripping portion and flange portion is from about 20° to about 30°.

4. The hanger of claim 1 wherein the flexible connecting means comprises a cord having a flexible plastic outer covering.

5. The hanger of claim 1 wherein the flexible connecting means comprises a chain.

* * * * *